US005560041A

United States Patent [19]

Walker

[11] Patent Number: 5,560,041

[45] Date of Patent: Oct. 1, 1996

[54] EQUESTRIAN KNEE GRIP-PAD AND PROTECTOR

[76] Inventor: Candi L. Walker, 125 Marsh Creek Dr., Downingtown, Pa. 19335

[21] Appl. No.: 438,791

[22] Filed: May 11, 1995

[51] Int. Cl.[6] ..... A41D 13/06

[52] U.S. Cl. ..... 2/24; 2/911

[58] Field of Search ..... 2/22, 23, 24, 2, 2/16, 908, 911

[56] References Cited

U.S. PATENT DOCUMENTS

| | | | |
|---|---|---|---|
| D. 341,005 | 11/1993 | Pratt . | |
| 2,446,654 | 8/1948 | Krcmar | 2/24 |
| 2,626,394 | 1/1953 | Davis | 2/24 |
| 3,916,446 | 11/1975 | Gooding | 2/421 |
| 3,945,046 | 3/1976 | Stromgren . | |
| 4,643,176 | 2/1987 | Mason et al. . | |
| 4,706,302 | 11/1987 | Padfield | 2/24 X |
| 5,033,124 | 7/1991 | Bucalo et al. | 2/22 X |
| 5,226,191 | 7/1993 | Mitchell . | |
| 5,255,391 | 10/1993 | Levine . | |
| 5,450,625 | 9/1995 | Hu | 2/22 X |

FOREIGN PATENT DOCUMENTS

| | | |
|---|---|---|
| 831375 | 1/1970 | Canada . |
| 2305143 | 10/1976 | France . |
| 2421638 | 11/1979 | France . |

*Primary Examiner*—Paul C. Lewis
*Attorney, Agent, or Firm*—Richard C. Litman

[57] ABSTRACT

An equestrian knee pad for gripping, allowing added contact at the knee with the saddle for better leg control, as well as protecting an equestrian's knees from tissue injury. A generally flattened pillow-like pad is affixed to two pair of flexible and elastic straps, each strap having an end proximate to the pad and an end distal to the pad. Each strap extends generally parallel outwardly from the long edge of the oval pad. The oval pad comprises two oval layers of a web fabric, creating an inwardly facing surface (being the surface to be worn against the knee) and an outwardly facing surface (being the surface to be worn against the saddle). The inwardly facing surface is preferably made of leather to minimize friction and provide a natural cushioning effect. The outwardly facing surface is preferably suede, a textured surface which naturally provides a gripping effect upon the leather of a saddle. A cushioned fill material lies between each of the layers and causes the pad to appear pillow-like. The fill material may be made of any cushioning material, but preferably is a foamed resilient material. The proximate end of each strap is sandwiched between the two oval layers and permanently stitched in place or otherwise attached.

9 Claims, 5 Drawing Sheets

EQUESTRIAN KNEE GRIP-PAD AND PROTECTOR

BACKGROUND OF THE INVENTION

1. Field of the Invention

The present invention relates to an equestrian knee pad for gripping a saddle and protecting an equestrian's knees from injury by chafing, abrasions or impact against a saddle.

2. Description of the Prior Art

Participants in equestrian sports have varying levels of ability which range from novice to dressage. Regardless of his or her level of skill, a rider's control and comfort in the saddle depend greatly upon the rider's skill with his or her legs and knees. The inner leg and knees are a point of contact with the saddle. Generally, the rider maintains a rhythmic motion in the saddle which causes the inner sides of the knee be irritated by the constant friction between the knee and the saddle. Furthermore, the rider frequently must grip the saddle with both knees to maintain stability in the saddle. Each of these actions often result in bruised or abraded skin of the rider's knees and inner leg.

For this reason, specialized equestrian pants (jodhpurs) often include panels, which protect the rider's legs in areas of contact with the saddle and provide added grip. However, these jodhpurs are expensive and are usually not acquired by the occasional equestrian rider. Furthermore, skilled riders owning jodhpurs often simply wish to wear their ordinary wearing apparel for a brief ride, yet desire the extra level of knee and leg comfort and grip afforded by the jodhpurs. Therefore, a current need exists for an invention in the field of equestrian riding equipment that would remedy these shortcomings. The present invention addresses these problems simply and inventively with a knee grip-pad and protector especially for equestrian riding.

Knee pads and athletic knee protectors are generally and well known in the prior art. Typically, however, knee protection devices serve bracing functions, impact absorbing functions, or knee-cap injury prevention functions, particularly as they relate to sports. Nevertheless, there is no knee pad presently available on the market or known in the prior art which is capable of cushioning the inner knee and inner leg from constant light friction and adding grip and added contact for increased leg control against an equestrian saddle while riding.

U.S. Pat. No. 5,255,391 issued Oct. 26, 1993, to Levine describes a knee pad formed by an oval patch sewn over a neoprene cushioning member onto a one-piece web body. The web body is shaped to form four extending tabs onto which hook and loop fasteners are attached. The knee pad strictly serves to lessen injury from the impact of a forward fall by snowboard riders, in-line skaters and ice skaters and teaches away from the present invention.

U.S. Pat. No. 3,945,046 issued Mar. 23, 1976, to Stromgren describes a knee support or wrap designed for stabilizing the knee ligaments of athletes. A tubular, elastic sheath covers the knee, and a pair of elastic straps are anchored to the sheath by use of hook and loop fasteners. Felt pads on the sheath under the straps provide added support and prevent bunching of the elastic sheath. The invention's use is intended as a flexible brace for the knee.

U.S. Pat. No. 4,643,176 issued Feb. 17, 1987, to Mason et al. also describes an athletic knee protector with a bowed leaf spring structure to protect an athlete from injury. The bowed leaf spring is hinged and supports a pair of pads above and below the knee on the leg in order to absorb impacts and redistribute the forces of lateral impacts received in sports such as football. Each pad is attached by hook and loop fasteners to a wide strap which wraps around the leg covering each pad.

U.S. Pat. No. 5,226,191 issued Jul. 13, 1993, to Mitchell describes a formfitting knee pad for protection of the inner portion of the knee joints of a racehorse. The knee pad, while being related to equestrian sports, is worn by the horse, not the rider, and is only intended to minimize the strike area between the horses knees while racing.

U.S. Pat. No. D341,005 issued Nov. 2, 1993, to Pratt shows an elbow or knee pad incorporating what appear to be rivets or grommets within a protective knee cap covering. Hook and loop fasteners are attached to two straps which attach above the knee cap covering. Canadian Patent No. 831375 issued Jan. 6, 1970, to Enicks shows a method of forming a knee pad, which is generally rectangularly shaped with two unitary straps attached thereto.

French Publication No. 2 305 143 published October 1976, features a knee protector comprising a round-surfaced outer cup with an inner cushion layer. Two straps are attached to the knee protector. French Publication No. 2 421 638 published November, 1979, shows a similar shaped knee protector with two straps.

None of the above inventions and patents, taken either singly or in combination, is seen to describe the instant invention as claimed.

SUMMARY OF THE INVENTION

The present invention relates to an equestrian knee pad for gripping, allowing added contact at the knee with the saddle for better leg control, as well as protecting an equestrian's knees from chafing. In the preferred embodiment, a generally flattened pillow-like oval pad is affixed to two pair of flexible and elastic straps, each strap having an end proximate to the oval pad and an end distal to the oval pad. Each strap extends generally parallel outwardly from the long edge of the oval pad.

The oval pad comprises two oval layers of a sheet material, creating an inwardly facing surface (being the surface to be worn against the knee) and an outwardly facing surface (being the surface to be worn against the saddle). The inwardly facing surface is preferably made of a sheet material such as leather which will minimize friction and provide a natural cushioning effect. The outwardly facing surface is preferably suede or other material having a napped surface; however, any sheet material which provides a gripping effect upon the leather of a saddle may be used.

A cushioned fill material lies between each of the oval layers and causes the oval pad to appear pillow-like. The fill material may be made of any cushioning material, preferably a foamed resilient material. The proximate end of each strap is sandwiched between the two oval layers and permanently stitched in place or otherwise attached.

The preferred embodiment of the present invention is best used by placing the oval pad against the inside of a rider's knee, over the rider's pants, so as to face inwardly toward the saddle. The pad is then secured by use of the pair of opposing straps. A hook and a loop fastener is affixed to the distal end of opposing straps. The fasteners mate so that one pair of straps may be removably and adjustably wrapped and secured around the rider's leg above the knee and the other pair likewise fastened below the knee. The straps are fabricated from an elastic material so that tightness of the pad against the rider's pants and leg can be maintained to minimize slippage of the pad against the rider's inner knee while gripping the saddle or otherwise riding.

Accordingly, it is a principal object of the invention to provide equestrian riding equipment which protects the knees and legs of a rider from chafing against a saddle.

It is another object of the invention to provide equestrian riding equipment which adds surface contact with the horse or saddle and grip when pressure is applied by the knee and leg of a rider, without the need for specialized riding pants.

It is a further object of the invention to provide an equestrian knee grip-pad and protector which is quickly and easily adjustable or removable from the knee and leg of a rider.

Still another object of the invention is to provide an equestrian knee grip-pad and protector that is simple and inexpensive to manufacture.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to an equestrian knee pad for gripping, allowing added contact at the knee with the saddle for better leg control, as well as protecting an equestrian rider's knees. Referring to the several views of the Figures, the preferred embodiment of the knee grip-pad and protector 10 is shown comprising generally of (1) a flattened pillow-like oval pad 12 and (2) two pair of flexible and elastic straps. Each strap 14 extends generally parallel outwardly from the long edge of the oval pad 12.

Figure 2:
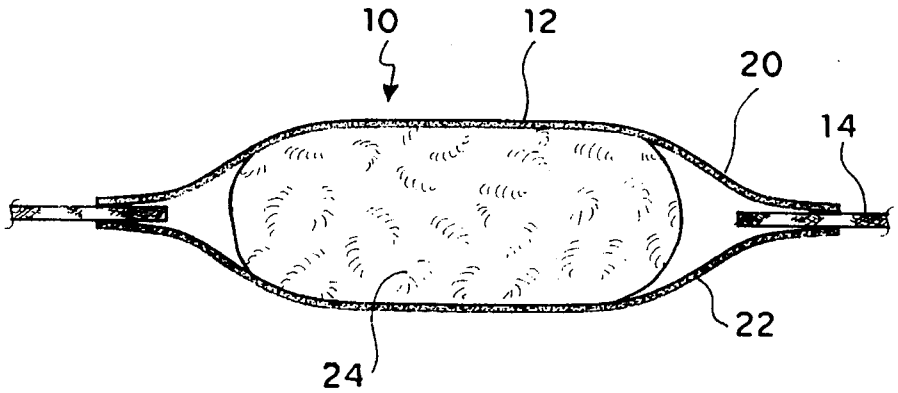
FIG. 2 is cross-sectional view of the equestrian knee grip-pad and protector.
Figure 1:
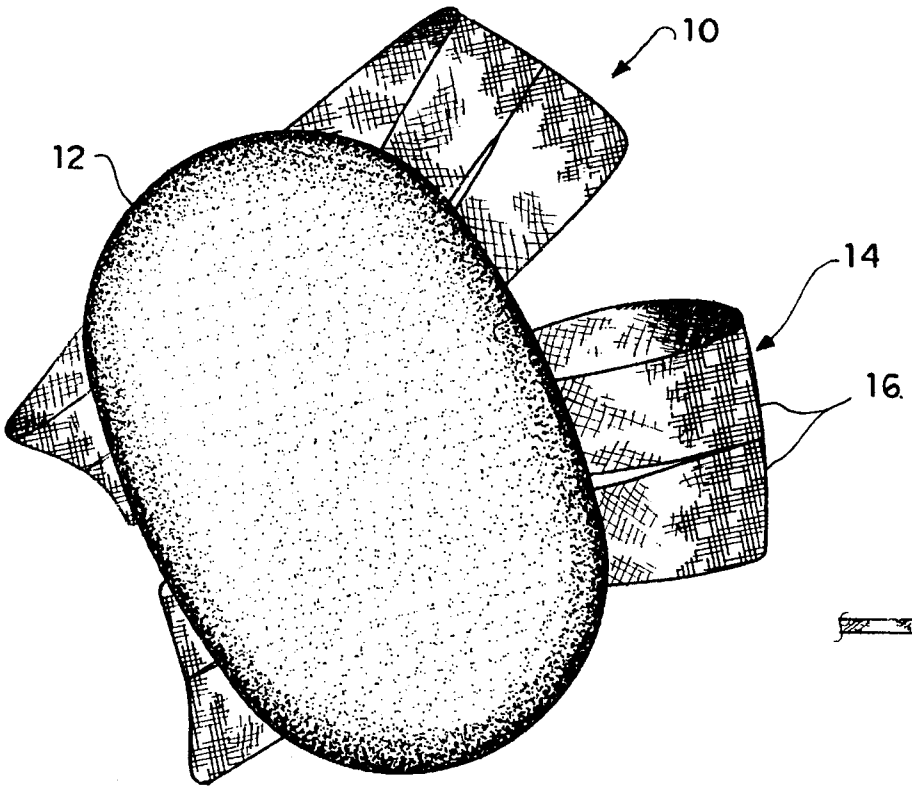
FIG. 1 is a perspective view of the equestrian knee grip-pad and protector.
Figure 3:
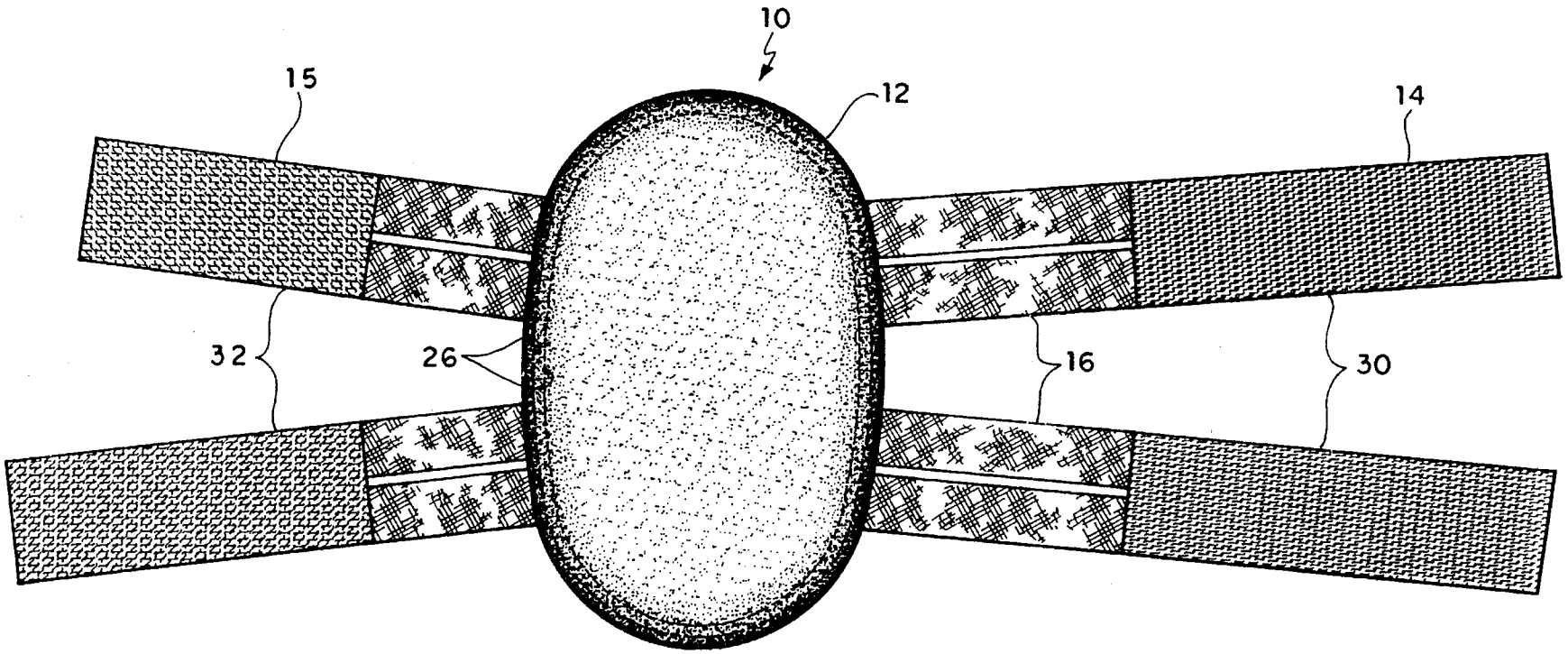
FIG. 3 is a front elevational view of the equestrian knee grip-pad and protector in an open flattened configuration.
Figure 4:
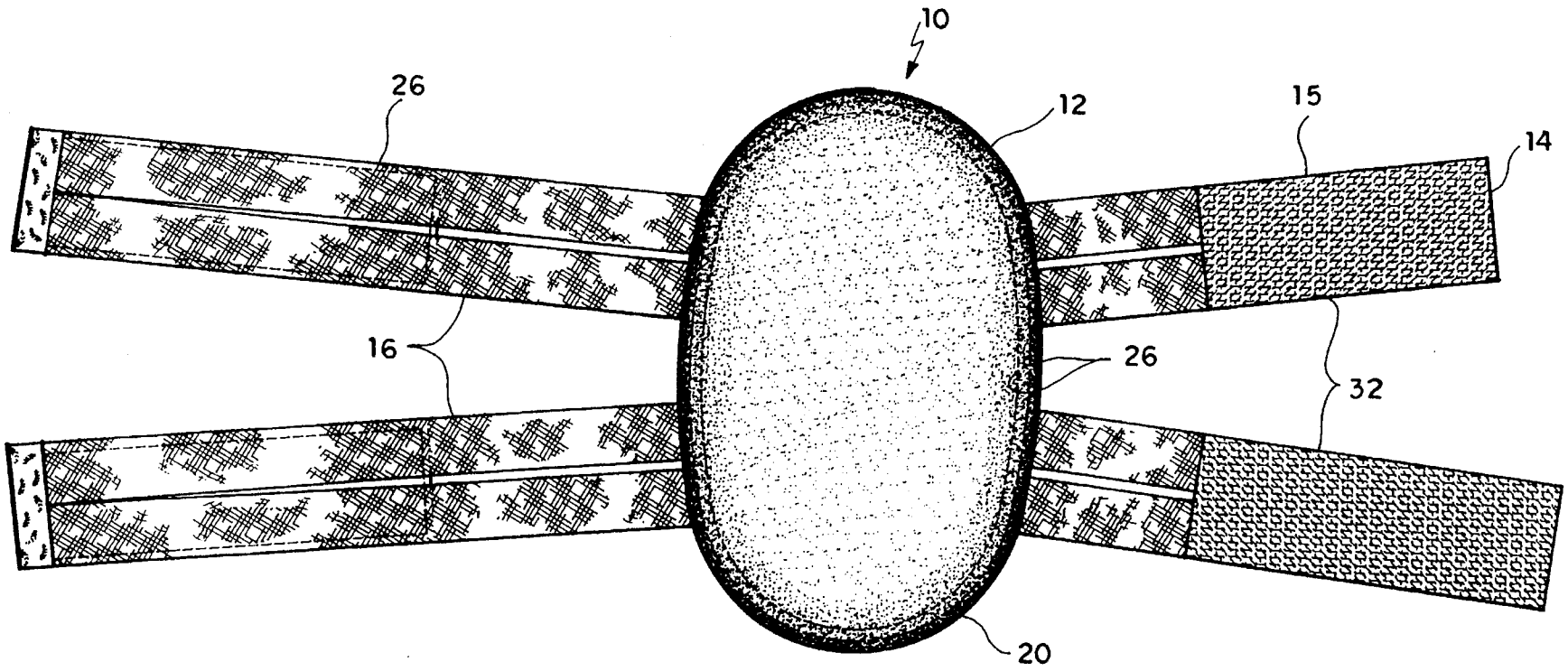
FIG. 4 is a rear elevational view of the equestrian knee grip-pad and protector in an open flattened configuration.

As can be best appreciated from FIGS. 2, 3 and 4 together, the oval pad 12 is made up of two oval layers 20,22 of a flexible sheet material, creating an inwardly facing surface (being the layer to be worn against the knee) 20 and an outwardly facing surface (being the layer to be worn against the saddle) 22 of the oval pad 12. The inwardly facing surface 20 is preferably made of leather to minimize friction and provide a natural cushioning effect. The outwardly facing surface 22 is preferably suede, a napped sheet material which provides a gripping effect upon the leather of a saddle.

As can be best appreciated from FIG. 2, a cushioned fill material 24 lies between each of the oval layers 20,22 and causes the oval pad 12 to appear pillow-like. The fill material 24 may be made of any cushioning material, preferably a foamed resilient material.

Referring now to FIGS. 2 and 3, each strap 14 has one end proximate to the oval pad and one end distal to the oval pad 12. The proximate end of each strap 14 is sandwiched between the two oval layers 20,22 and is permanently stitched in place or otherwise attached. The stitching lines are shown at 26. Each strap 14 is further made from of a pair of individual elastic bands 16 running substantially contiguously with one another, which are stitched together to form one strap 14. The elastic bands 16 allow stretch so as to regulate the tightness of the pad against the rider's pants and leg. The bands thereby minimize slippage of the pad against the rider's inner knee. In contrast with a unitary strap of width equal to the combined width of the two bands 16, the dual-banded strap adds control over the tension of the strap; a wider band would be stiffer and harder to stretch. Consequently, the less-stiff elastic bands 16 allow greater comfort control. Flexibility is also added, allowing the straps to lay flatter against the leg than a single unit strap of double width, reducing slippage of the rider's pants' fabric beneath the straps and consequential bunching of the fabric around the straps 14.

As can be best appreciated from FIGS. 3 and 4, a generally rectangular patch of hook fastener 30 is attached to each of the distal ends of two straps which run substantially contiguously and parallel with one another, so that the hooks face outwardly. On each of the two straps attached to the opposite side of the oval pad 12, a generally rectangular patch of loop fastener 32 may be attached to one or both sides of each of the straps 14. The preferred embodiment shows the loop fastener on both sides of each of two straps. A generally rectangular patch of the loop fastener 32 is clasped onto each end of each of the straps so as to form a continuous band, wherein the loops first face inwardly and then, by a return bend, face outwardly. The loops facing inwardly may act to matingly engage with the hooks facing outwardly so that matingly opposing straps can be removably and adjustably wrapped and secured around the rider's leg. The outwardly facing loop fastener 32 functions only to hide the stitching lines 26 and thus serves merely for aesthetic purposes. Stitching lines are located around the rectangular perimeter of each of the hook and loop fastener web material.

In the embodiment as shown in the FIGS. 3 and 4, a short strap 15 is shown. The short strap 15 opposes one of the straps with a loop fastener, which together fasten below the knee. This short strap 15 accommodates the circumference of the lower leg; hence the strap is shortened as compared to the companion strap which encircles the relatively larger circumference of the upper leg of a human individual.

Figure 5:
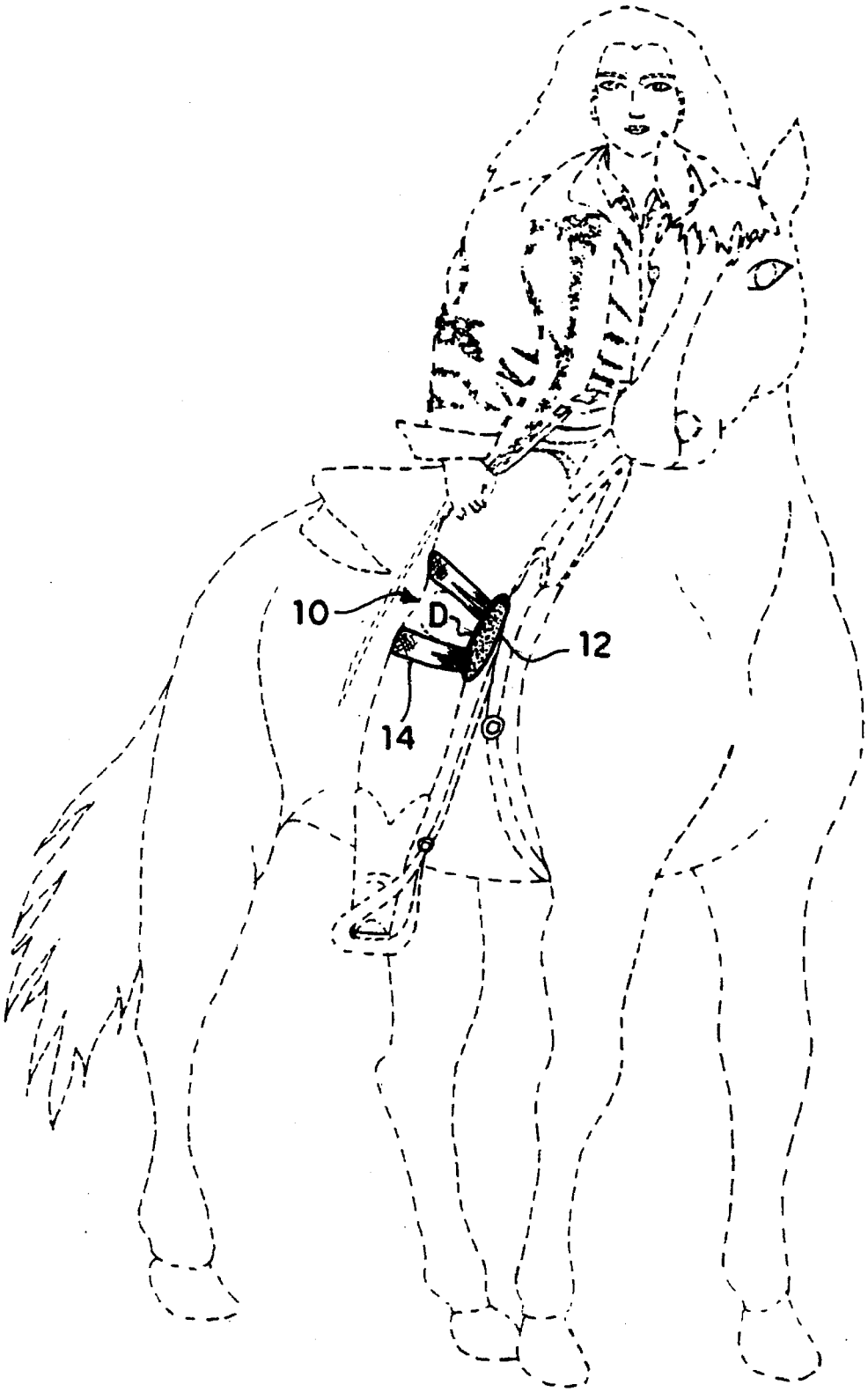
FIG. 5 is perspective view of an embodiment for adults of the equestrian knee grip-pad and protector in use.
Figure 6:
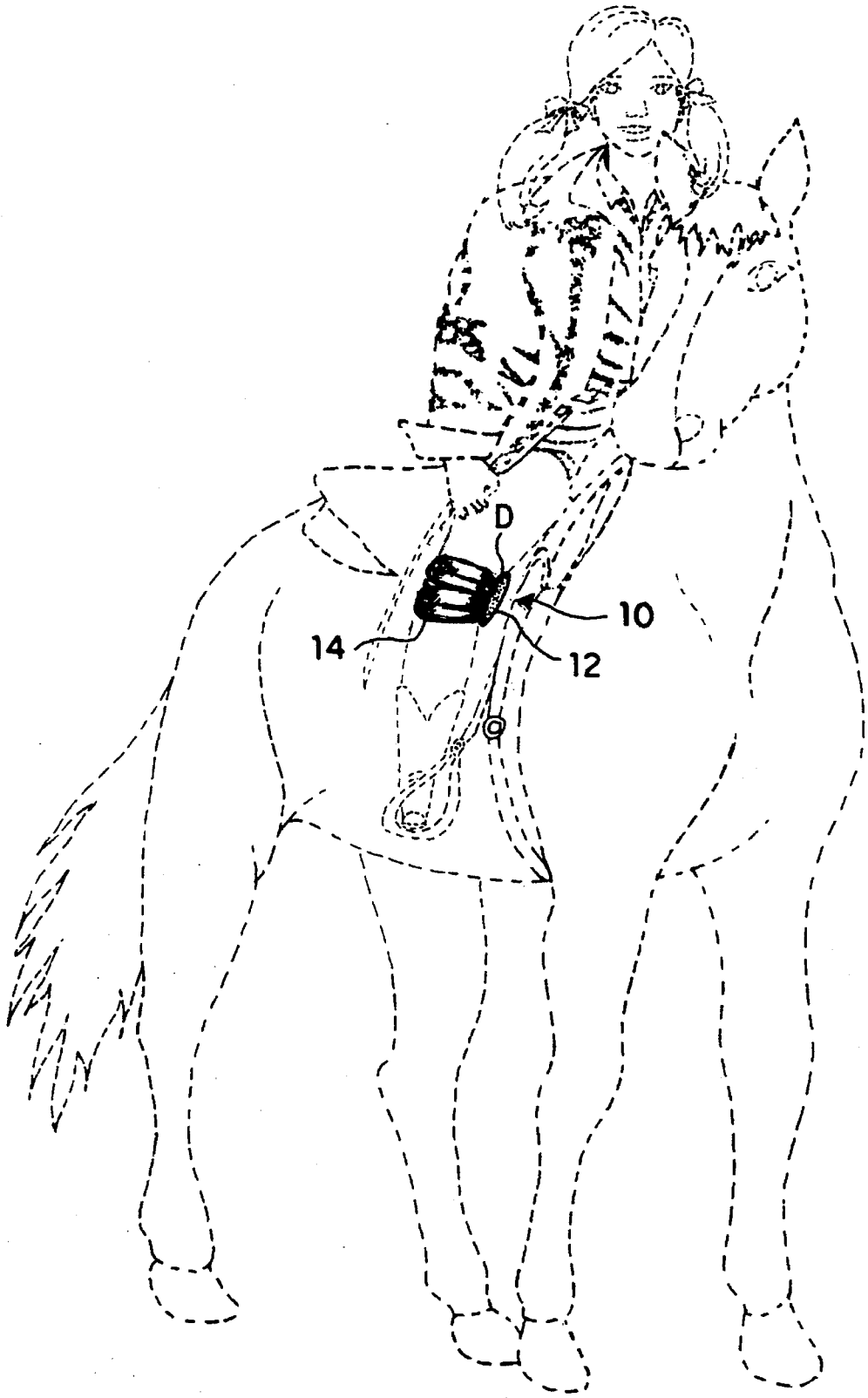
FIG. 6 is perspective view of an embodiment for children of the equestrian knee grip-pad and protector in use.

Obviously, the present invention can also be fitted to the size of the individual by increasing or decreasing the size of the oval, the length of the straps, and the relative spacing between the straps. In FIG. 5 an "adult" size equestrian knee grip-pad and protector 10 is shown to have straps 14 spaced apart at a predetermined distance D on the oval pad 12; in contrast in FIG. 6, a "children's" size equestrian knee grip-pad and protector 10 is shown to have straps 14 spaced apart at a lesser distance D. This relationship is necessitated by the greater surface area of an adult's leg and knee which must be covered to provide adequate grip and protection.

It is to be understood that the present invention is not limited to the embodiments described above, but encompasses any and all embodiments within the scope of the following claims.

I claim:

1. An equestrian knee grip-pad and protector comprising:

a pad adapted to fit onto the medial side of a knee and leg of a rider, said pad having a first surface facing towards the knee upon which the pad is worn and a second surface facing outward from the knee upon which the pad is worn, said pad first surface being a flexible sheet material, and said pad second surface being a flexible sheet material of napped surface so that surface friction is increased; and, a plurality of straps, each strap having a proximate end and a distal end, each said proximate end being permanently affixed to said pad in a configuration forming opposed pairs of straps, each said strap having a mating component of a hook and loop fastener attached to each said distal end, each said strap further includes a pair of elastic bands to allow greater flexibility of the strap, whereby said pairs of straps may be wrapped around the leg so as to have said distal ends mate and secure the equestrian knee-grip pad and protector to the inner leg and knee, each said fastener further comprising a patch attached on a surface of one said distal ends and joining together said pair of elastic bands.

2. The equestrian knee grip-pad and protector according to claim 1, wherein said pad further includes an internal cushioning means for the knee and leg, for further protection during contact of the knee and leg with the surface of an equestrian saddle, said cushioning means being integrally and fixedly secured between said first surface and said second surface.

3. The equestrian knee grip-pad and protector according to claim 1, wherein the second surface is suede.

4. The equestrian knee grip-pad and protector according to claim 1, wherein the said plurality of straps further comprise four straps.

5. The equestrian knee grip-pad and protector according to claim 1, wherein each said hook fastener is attached on an outward facing surface of one said distal end, and said loop fastener is attached on an inward facing surface on an opposite distal end.

6. The equestrian knee grip-pad and protector according to claim 5, wherein said patch of loop fastener is stitched to the outward facing surface of said distal end of each said strap, whereby the loop fastener hides the stitching.

7. The equestrian knee grip-pad and protector according to claim 1, wherein said straps are dimensioned and configured to accommodate the relative difference between the lower circumference and upper circumference of the rider's leg.

8. The equestrian knee grip-pad and protector according to claim 1, wherein said opposed pairs of straps further comprising at least one short pair and at least one long pair wherein the combined length of said straps of said short pair is less than the combined length of the said straps of said long pair, whereby said short pair may be used to wrap and secure the equestrian knee grip-pad and protector around the lower leg of the rider and said long pair may be used to wrap and secure the equestrian knee grip-pad and protector around the upper leg of the rider.

9. The equestrian knee grip-pad and protector according to claim 1, wherein said pair of elastic bands on each said strap run from said distal end to said proximate end of said strap and are secured to one another at said distal end.

* * * * *